United States Patent [19]

Koller

[11] Patent Number: 5,074,132

[45] Date of Patent: Dec. 24, 1991

[54] APPARATUS FOR LIMITING THE SPREADING OF A TREATMENT LIQUID BEING SPRAYED ONTO A TEXTILE MATERIAL

[75] Inventor: Abraham Koller, Kreuzlingen, Switzerland

[73] Assignee: Biac Holding AG, Switzerland

[21] Appl. No.: 567,567

[22] Filed: Aug. 15, 1990

[30] Foreign Application Priority Data

Aug. 29, 1989 [CH] Switzerland ..... 3124/89

[51] Int. Cl.[5] ..... D06B 1/02; D06B 15/04

[52] U.S. Cl. ..... 68/205 R; 15/322; 118/326; 239/103; 239/120

[58] Field of Search ..... 68/5 A, 205 R, 240; 15/322, 339, 415.1; 239/103, 120; 118/326, DIG. 7

[56] References Cited

U.S. PATENT DOCUMENTS

| | | | |
|---|---|---|---|
| 716,313 | 12/1902 | Thurman | 15/415.1 X |
| 2,488,195 | 11/1949 | Ivey | 118/326 X |
| 2,694,914 | 11/1954 | Glover | 68/240 |
| 3,747,155 | 7/1973 | Koellisch | 15/322 |
| 3,958,298 | 5/1976 | Cannan | 15/322 |
| 4,132,189 | 1/1979 | Greve et al. | 118/326 X |
| 4,397,259 | 8/1983 | Kanda et al. | 118/326 X |
| 4,926,514 | 5/1990 | Leuenberger | 68/205 R X |

FOREIGN PATENT DOCUMENTS

| | | | |
|---|---|---|---|
| 959095 | 9/1949 | France . | |
| 0584898 | 12/1977 | U.S.S.R. | 239/120 |
| 1059341 | 2/1967 | United Kingdom . | |
| 2026552 | 2/1980 | United Kingdom . | |

*Primary Examiner*—Philip R. Coe

*Attorney, Agent, or Firm*—Diller, Ramik & Wight

[57] ABSTRACT

An annular body has an outer wall member and an inner wall member. A hollow space is present between these two wall members. A connector in the outer wall member provides for a communication between the hollow space and a source of induced draught. The inner wall includes perforations and through holes which form a communication between the space surrounded from the inner wall and the hollow space and finally the connector to the source of induced draught. A rib is located at the lower end of the annular body. If the apparatus is placed on an area of a material, against which cleaning fluids are sprayed, the inner wall limits a spreading of the liquid bouncing away from the material. The liquid flowing down the inner wall is transported off specifically through the perforations. Liquid spreading on the material is transported off by further through holes located at the rib.

Accordingly a spreading of treatment liquids sprayed against a textile material is positively limited, such it is not necessary to use further measures and suffer longer drying times in order to reach a completely dry state of the treated area and the areas surrounding this area. Furthermore, that part of the liquid which is not pressed through the material for a cleaning thereof is completely and effectively removed by the apparatus.

8 Claims, 2 Drawing Sheets

APPARATUS FOR LIMITING THE SPREADING OF A TREATMENT LIQUID BEING SPRAYED ONTO A TEXTILE MATERIAL

BACKGROUND OF THE INVENTION

1. Field of the Invention

The present invention relates to an apparatus for limiting the spreading of a treatment liquid being sprayed onto a textile material treated therewith. It also relates to a device for removing stains and dirt from a textile material combined with the apparatus for limiting the spreading of a treatment liquid being sprayed onto the textile material.

2. Description of the Prior Art

In order to remove spots from textile materials, i.e. planar textile products, it is generally known to spray a liquid spot remover, pressurized liquids including a washing agent having a low lathering power and also merely water against the area to be cleaned. It is hereto known, for instance, to direct a pressurized liquid which includes a washing agent having a low lathering power and also the water against the area to be cleaned in form of a sharp pulsating jet.

Because now on the one hand an ascertaining if the dirt has indeed been removed from the respective area can proceed only after the area has been dried and because specifically in case of an improper cleaning so-called dirt rings may be generated, efforts are made to keep the extent of the area which is wetted for a cleaning thereof as small as possible. The spreading of a liquid sprayed onto an area or spot, respectively, to be cleaned can occur basically in three fashions.

A part of the droplets which are sprayed against the textile material bounce back away from the material and spatter in all directions such that an area is wetted which is considerably larger than actually intended. Quite obviously the relative amount of the liquid droplets which bounce off depends on the density of the fabric or how fine the meshes of the textile material are. A further part of the treatment liquid does not penetrate completely through the fabric in order to be removed at its bottom or rear, respectively, side, e.g. by means of a sucking off. This part flows on the surface of the textile fabric away and outwards from the area which has been wetted. A further part of the liquid sprayed onto the textile material does indeed penetrate the fabric, is however not in the position to completely flow through the fabric in order to be sucked off at the reverse side of the fabric by means of a source of induced draught. This part of the liquid spreads within the fabric proper e.g. by capillary action or in that the individual fibers absorb the liquid.

This unwanted spreading of the cleaning liquid depends such as set forth above on the fabric proper whereby not all textile materials are penetrable to the same extent. In case of relatively coarse woven or knitted, respectively, textile fabrics up to 95% of the liquid sprayed thereagainst can penetrate through the meshes. In case of e.g. more densely woven fabrics or such which have been treated with corresponding impregnating agents the extent of the penetration is much more limited. It is known that in specific cases only 10 to 20% of the liquid sprayed onto such material penetrates completely through the textile material and the largest portion thereof, i.e. up to 90% is atomized above the material in the air or remains as a puddle of liquid on the surface thereof. The smaller the portion of the volume of the amount of the liquid which truly penetrates through the material to be cleaned is, the larger the totally sprayed amount of liquid must obviously be, and accordingly, the unwanted spreading of the treatment liquid in and on the material occurs.

Specifically in textile plants it is known to guide the webs of the fabrics or the areas thereof to be examined and to be cleaned not horizontally but rather slanted and oftentimes almost vertically such that the spreading of the liquid placed thereupon, of the wet spot is highly influenced by the forces of gravity and accordingly, a considerable wetting of a downwards extending area of the material is suffered.

SUMMARY OF THE INVENTION

Accordingly, it is a general object of the invention to provide an apparatus for limiting the spreading of a treatment liquid being sprayed onto a textile material treated therewith, which apparatus comprises a hollow annular body having at least one outer wall member and at least one inner wall member and a resting surface at one face end, at which resting surface the annular body is placed onto a respective textile material during the treating thereof, which at least one outer wall member and which at least one inner wall member define a hollow space located therebetween, which hollow space is to communicate with a source of induced draught and which at least one inner wall member includes means for drawing fluids flowing down the inner surface of the inner wall member off into the hollow space before these fluids reach the area of the resting surface.

A further object is to provide a device for removing stains and dirt from a textile material, which device includes a discharge head for discharging a pulsating jet of at least one cleaning liquid and a perforated support for supporting an area of the textile material to be cleaned and communicating with a source of induced draught, and an apparatus for limiting the spreading of the cleaning liquid being sprayed onto the area of the textile material being treated therewith, which apparatus includes a hollow annular body having at least one outer wall member and at least one inner wall member and a resting surface at one face end, at which resting surface the annular body is to be placed onto the area of the textile material during its treatment, which at least one outer wall member and which at least one inner wall member define a hollow space located therebetween, which hollow space communicates with the source of induced draught and which at least one inner wall member includes means for drawing fluids flowing down its inner surface off into the hollow space before they reach the area of the resting surface; which apparatus comprises a connector extending through a respective outer wall member of the hollow body forming a connection between the hollow space and the source of induced draught, which resting surface comprises perforations forming a connection therefrom to the same source of induced draught; which discharge head has a diameter of a magnitude relative to the diameter of the hollow space such that the discharge head can be inserted into the inner space of the hollow annular body enclosed by the inner surface of the inner wall member, whereby the spreading of the cleaning liquid discharged from the discharge head against the area of the textile material being treated in and on the textile material is limitable by the apparatus.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
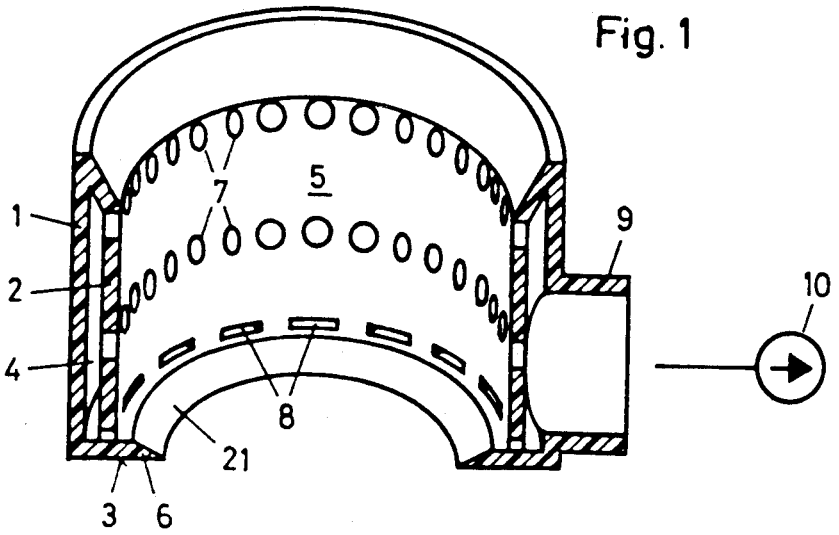
FIG. 1 illustrates a sectional view of a first embodiment of an apparatus for limiting the spreading of a treatment liquid being sprayed onto a textile material.

The embodiment of the apparatus for limiting the spreading of a treatment liquid illustrated in FIG. 1 has basically the shape of an annular body. According to the illustration which is for exemplary purposes only this annular body has a circular cross-sectional shape. Quite obviously the annular body may have a shape which differs from a circle and embodiments may be foreseen, according to which the annular body is split at one or a plurality of locations along e.g. a generatrix such that it incorporates the form of a ring which has been cut at several places.

The embodiment of the annular body illustrated herein includes an outer wall member 1 and an inner wall member 2 extending coaxially to the outer wall member 1. These wall members 1, 2 are interconnected along their edges. Accordingly, a hollow space 4 is formed between these two members. At the lower end of the annular body, at which the two wall members 1, 2 are interconnected, a resting surface 3 is present. In operation the annular body is placed at its resting surface 3 onto the respective area of the textile fabric which is being treated. A rib member 6 projects off the inner wall member 2, which rib member 6 is directed into the space 5 enclosed by the annular body proper. As can be seen clearly, the bottom side surface of the rib member 6 which is aligned with the resting surface 3 forms thus basically a part thereof.

A plurality of perforations 7 penetrate the inner wall member 2, which perforations 7 are aligned in the direction of the inner circumference of the wall member 2 and accordingly form a communication between the space 5 enclosed by the annular body and the hollow space 4. A further group of through holes 8 is located immediately above the rib member 6. Although not specifically illustrated in the figures, it is possible that further ribs projecting into the space 5 are present, it is e.g. possible to have a rib immediately under the lowermost row of the perforations 7.

A connector 9 is shaped in the outer wall member 1, via which the hollow space 4 may be connected to a source of induced draught 10.

The handling, manipulating and operation of this embodiment of the inventive apparatus is as follows, whereby attention is also drawn to the schematic illustration of FIG. 4.

The annular body is placed at its resting surface 3 onto the area of the fabric which is to be treated, which fabric in turn rests on a perforated support e.g. a support having a wire mesh, which support is connected to a source of induced draught 10. The discharge head 18 for discharging a respective treatment liquid (and also drying air) is movably supported over the annular body, e.g. by a hanging arrangement. In order to treat a soiled area or spot, respectively, the discharge head 18 is moved down into the space 5 enclosed or encircled, respectively, by the annular body and thereafter the respective treating liquid, which may be present in form e.g. of a sharp, pulsating jet, is sprayed against and through mentioned soiled area.

The droplets of the liquid which bounce off the fabric splash onto the inner wall member 2 such that no further spreading of these droplets and conclusively wetting of adjacent areas of the textile fabric may occur. Thus, the inner circumferencial surface of the inner wall member 2 is wetted and the liquid flowing therealong downwards due to the gravity force is sucked off on the one hand through the perforations 7 into the hollow space 4 and on the other hand from the hollow space 4 through the connector 9. It is obvious that an airflow prevails in the enclosed space 5 which is directed towards these perforations 7 such that specifically fine droplets are sucked more or less directly into the perforations 7. Those parts of the liquid which are not sucked off through the perforations 7 flow downwards along the inner surface of the inner wall member 2 up to the rib member 6 and are sucked off from latter location through the lower through holes 8 again into the hollow space 4 and from there through the connector 9. In case a further rib is arranged e.g. immediately under the lower row of perforations 7, a certain accumulation of the liquid occurs already at that area which then is sucked off through the perforations 7 also located at that area.

A spreading of any liquid remaining on the surface of the fabric being treated is now also no longer possible. The spreading proceeds up to the inner edge of the rib member 6, which rib member 6 includes an incline 21 such that a relatively sharp edge is provided. Due to the airflow present at this location the liquid is sucked off upwards along the incline 21 and from there into the through holes 8. This is true also for that part of the liquid which saturates or wets the fabric. Also here the removal of this liquid proceeds by a sucking off through the lower through holes 8.

Figure 2:
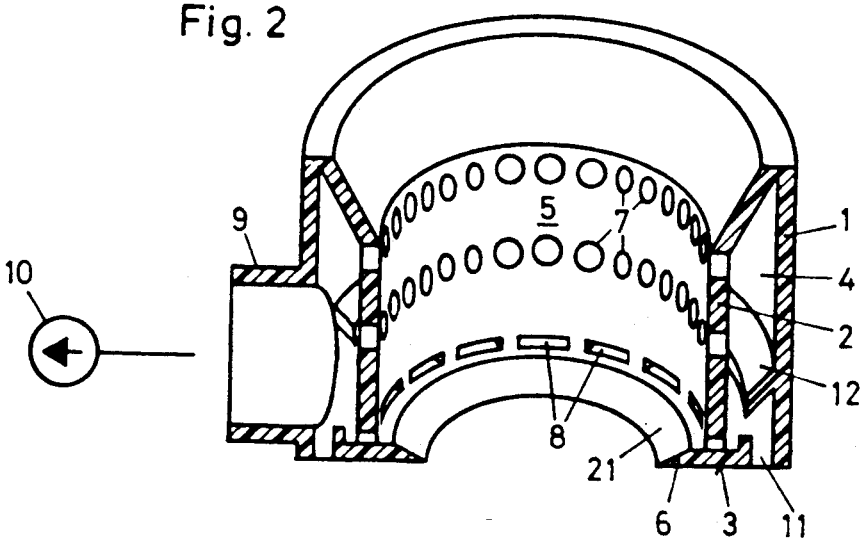
FIG. 2 illustrates a second embodiment of the apparatus in accordance with the invention.

Attention is now drawn to FIG. 2. The embodiment illustrated in FIG. 2 is intended specifically for an operation in case of textile fabrics having relatively dense meshes, which fabrics give rise to an increased possibility of a forming of a standing liquid layer on the surface of the textile material. This embodiment differs from the above disclosed embodiment in that further through holes 11 leading to the hollow space 4 are located directly at the resting surface 3. Accordingly, that part of the liquid which flows outwards under the rib member 6 and along the resting surface 3 is sucked off via these further through holes 11 into the hollow space 4. Furthermore, an inner circumferential rib 12 projects from the outer wall member 1 into the hollow space 4, which inner circumferential rib 12 is located above the further through holes 11. This rib 12 acts as guide plate in order to support the direction of flow from the further through holes 11 towards the connector 9. As mentioned, this embodiment according to FIG. 2 is specifically to be used in such case when materials are present which have a structure which give an increased danger that a standing pool of liquid is formed or accumulates, respectively, on the upper surface of this material.

Figure 3:
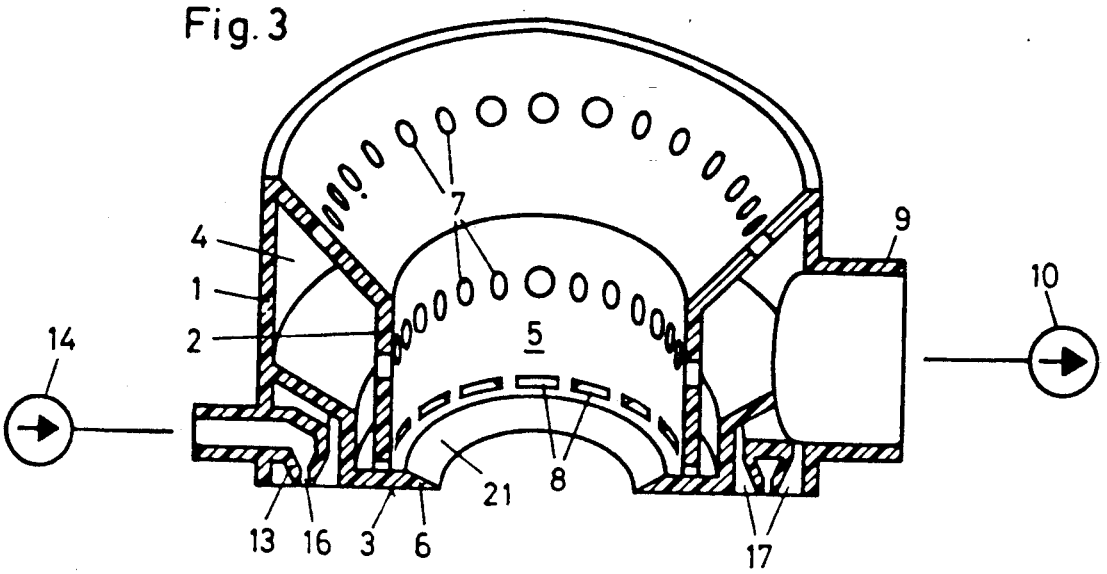
FIG. 3 illustrates a third embodiment of the apparatus in accordance with the invention.

The embodiment according to FIG. 3 is specifically advantageous in such cases where the textile material is structured such that there is the danger, that the liquid spreads strongly within the material e.g. by capillary action, absorbing capacity of the fibers etc. A pressurized air supply body 13 is formed in the annular body, which pressurized air supply body 13 may again be a closed or open ring. Pressurized air stemming from a source 14 of pressurized air, which may supply hot or cold air at a high pressure, flows out through the pressurized air outlet openings 16 towards the textile material such that liquid present at that area is forced through and out of the material with an increased force. It shall be noted, that the material being treated rests on a perforated support 19, which communicates at its bottom with a source 10 of induced draught (see FIG. 4). Quite obviously a part of the pressurized air exiting out of the openings 16 will not be able to penetrate completely through the material such that a lateral escaping on the material or immediately under its upper surface can occur. In order now to prevent a spreading of the liquid, i.e. a further wetting due to this laterally exiting amount of pressurized air, return flow openings 17 are arranged at both sides of the air outlet openings 16, which return flow openings 17 lead again to the connector 9 to the source 10 of induced draught such that pressurized air escaping laterally is sucked off directly adjacent the pressurized air outlet openings 16 such that a spreading of the liquid within the material is prevented.

Figure 4:
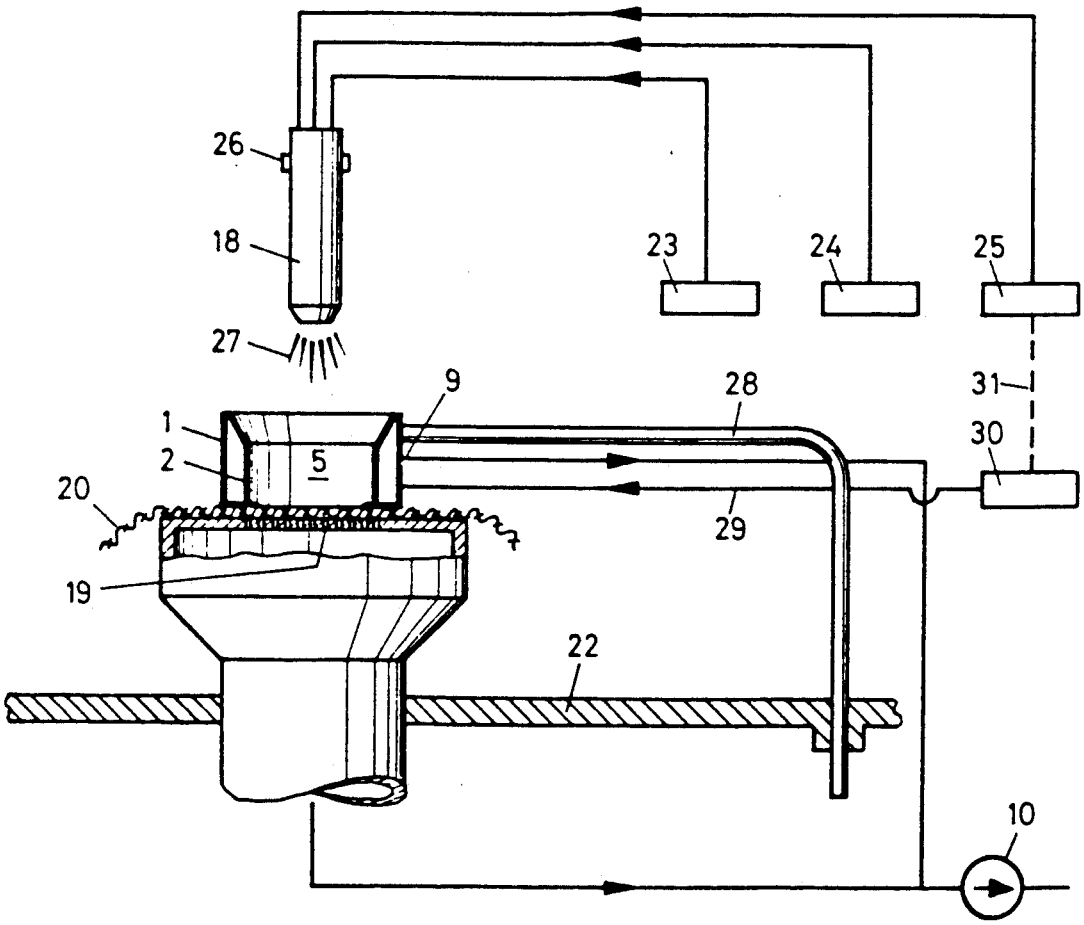
FIG. 4 is a schematic view of a device for removing spots and stains which includes an embodiment of the apparatus in accordance with the present invention.

Attention is now drawn to FIG. 4. FIG. 4 illustrates on a schematic basis only an embodiment of the inventive apparatus in combination with a device for removing dirt and contaminants out of a textile material. Such a device is e.g. available on the market under the trade name "Fleckenreinigungs-System 100 vom Krebs Switzerland" (spot cleaning apparatus system 100 of Krebs Switzerland) and accordingly generally known. For this reason FIG. 4 is a purely schematic illustration of such a device where additionally only those structural parts are designed which are necessary for an understanding of the present invention.

The perforated support 19, onto which the textile material 20 to be cleaned is placed, communicates with a source 10 of induced draught. Reference numeral 22 identifies the worktable. Three fluids are led into the discharging head 18. One fluid is a pressurized liquid containing a washing agent of low lathering power, which is supplied from a corresponding unit (supply tank, pump, possible heater) 23. A further liquid is water stemming from a source 24, which water is supplied at a high pressure and in a pulsating manner which is also true for the previously mentioned fluid. The reference numeral 25 identifies the supply of pressurized air. These three fluids 23, 24, 25 flow through conduits into the discharge head 18, which has push-buttons for supplying and interrupting, respectively, the respective fluid flows. The fluid jets flowing out of the discharging head 18 are generally identified by the reference numeral 27. An apparatus for limiting the spreading of treatment liquid structured in accordance with the present invention is now supported at a pivot arm 28 supported in turn in the table 22. As can be seen, the connector 9, via which the induced draught out of the space 5 occurs, is in communication with the source 10 of induced draught, e.g. an air pump which is the same pump which generates the induced draught under the perforated support 19. In case an embodiment of the apparatus according to FIG. 3 is used, which embodiment needs additionally a supply of pressurized air, a pressurized air supply line 29 is provided, which leads to a source 30 of pressurized air. This source is illustrated in FIG. 4 as separate unit; it is, however, obvious that such as illustrated by the broken line 31, the source 30 of pressurized air may be identical to the source 25 of pressurized air and if different pressures must prevail in the respective air supply lines, pressure control valves are mounted to operate accordingly.

In order to treat the textile material 20 it is placed as generally known over the perforated support 19 and thereafter the annular body is pivoted such that it is located thereupon. Thereafter the source 10 of induced draught is placed in operation such that the vacuum is generated below the perforated support 19. Finally the soiled area is treated by the various fluids in accordance with the operation of the known cleaning or spot removal device.

To this end the discharging head 18 which is connected to flexible supply lines is pulled downwards such that its front end portion is located within the space 5 and at a small distance from the textile material 20 being treated, whereby now conclusively the annular body surrounding the discharging head 18 submerged therein prevents positively the undesired spreading of the respective liquids jetted onto the material.

It shall be noted, finally, that the illustrated embodiment also in accordance with FIG. 4 is a mere example. In a textile plant, in which relatively broad webs of textile fabrics are examined and cleaned when necessary, the perforated support 19 may be an elongated structure, whereby the spreading limiting apparatus is not necessarily supported by means of a pivot arm, but rather in any other way such that a lateral transversal movement thereof over the entire width of the textile web is possible.

While there are shown and described present preferred embodiments of the invention, it is to be distinctly understood that the invention is not limited thereto, but may be otherwise variously embodied and practiced within the scope of the following claims.

I claim:

1. An apparatus for limiting the spreading of a treatment liquid being sprayed onto a textile material treated therewith, comprising a hollow annular body having at least one outer wall member and at least one inner wall member and a resting surface at one face end, at which resting surface the annular body is placed onto a respective textile material during the treatment thereof, said at least one outer wall member and said at least one inner wall member defining a hollow space located therebetween which hollow space is to communicate with a source of inducted draught, and which said at least one inner wall member includes means for drawing fluids flowing down the inner surface of the inner wall member off into said hollow space before they reach the area of said resting surface, the wall members defining the hollow space are interconnected at their respective edge areas and one of the interconnecting areas includes said resting surface, and in which said means for drawing off fluids include at least one rib member extending along the inner circumference of each inner wall member and directed against the space encircled by the hollow annular body and perforations and through holes in the respective inner wall member, which connect the space encircled by said annular body to the hollow space between the inner and outer wall members, and in which said hollow space is communicable with a source of induced draught by a connector extending through a respective outer wall member.

2. The apparatus of claim 1, wherein said rib member is located at said interconnecting area which includes the resting surface such that a part of the resting surface is formed by a surface of said rib member.

3. The apparatus of claim 2, wherein a plurality of perforations and through holes are arranged group-wise in the direction of the inner circumference of the inner wall member, of which groups one group is arranged such that it extends immediately adjacent of said rib member.

4. The apparatus of claim 3, wherein said interconnecting area containing said resting surface is perforated by a further group of through holes which form connections leading from said resting surface to the hollow space between the at least one outer and at least one inner wall members, which further through holes provide accordingly a communication to the source of induced draught.

5. The apparatus of claim 4, in which an inner circumferential rib projects from the inner surface of a respective outer wall member into said hollow space and above said further group of through holes, which rib terminates at a distance from the outer surface of a respective inner wall member and acts as guide plate for the flow of a fluid flowing in through said further group of through holes and out through the connector to the source of induced draught.

6. The apparatus of claim 3, comprising further a pressurized air supply body which extends at least partly annularly between a respective outer wall member and a respective inner wall member, and borders at a respective hollow space and includes a pressurized air supply stub connectable to a source of pressurized air and a plurality of pressurized air outlet openings which are arranged and located such that if in operation the apparatus is placed on a respective textile material being treated the pressurized air is directed against same.

7. The apparatus of claim 6, in which return flow openings are located immediately adjacent said pressurized air outlet openings and communicate with said connector to the source of induced draught, whereby a return flow of air from the area of the respective resting surface adjacent said pressurized air outlet openings to said connector to the source of induced draught is made possible.

8. In combination a device for removing stains and dirt from a textile material, which device includes a discharge head for discharging a pulsating jet of at least one cleaning liquid and a perforated support for supporting an area of the textile material to be cleaned and communicating with a source of induced draught, and an apparatus for limiting the spreading of said cleaning liquid being sprayed onto said area of the textile material being treated therewith, which apparatus includes a hollow annular body having at least one outer wall member and at least one inner wall member and a resting surface at one face end, at which resting surface the annular body is to be placed onto said area of the textile material during its treatment, which at least one outer wall member and which at least one inner wall member define a hollow space located therebetween, which hollow space communicates with said source of induced draught and which at least one inner wall member includes means for drawing fluids flowing down its inner surface off into said hollow space before they reach the area of said resting surface;

said apparatus comprising a connector extending through a respective outer wall member of the hollow body forming a connection between said hollow space and said source of induced draught, said resting surface comprising perforations forming a connection therefrom to the same source of induced draught; said discharge head having a diameter of a magnitude relative to the diameter of said hollow space such that said discharge head can be inserted into the inner space of said hollow annular body enclosed by the inner surface of said inner wall member, whereby the spreading of the cleaning liquid discharged from said discharge head against the area of the textile material being treated in and on the textile material is limitable by said apparatus.

* * * * *